United States Patent [19]

Hribar

[11] 4,146,222

[45] Mar. 27, 1979

[54] FLUID FILLED EXERCISE DEVICE

[76] Inventor: Albert F. Hribar, Box 3851, San Diego, Calif. 92103

[21] Appl. No.: 829,432

[22] Filed: Aug. 31, 1977

[51] Int. Cl.[2] ..... A63B 23/04

[52] U.S. Cl. ..... 272/70; 272/130

[58] Field of Search ..... 272/70, 65, 100, 101, 272/109, 130, 1 R, 1 E, 1 B; 35/29 R, 17; 417/473; 92/37, 38, 39; 5/368, 371, 369, 350

[56] References Cited

U.S. PATENT DOCUMENTS

| | | | |
|---|---|---|---|
| 348,361 | 8/1886 | Van Order | 417/473 |
| 3,529,474 | 9/1970 | Olson et al. | 272/130 X |
| 3,578,318 | 5/1971 | Young | 272/1 R |
| 3,785,642 | 1/1974 | Sterlicchi | 272/70 |
| 3,808,706 | 5/1974 | Mosley et al. | 35/17 |

FOREIGN PATENT DOCUMENTS

| | | | |
|---|---|---|---|
| 2261989 | 6/1974 | Fed. Rep. of Germany | 272/70 |
| 2436018 | 2/1976 | Fed. Rep. of Germany | 272/70 |
| 330903 | 10/1935 | Italy | 417/473 |
| 13672 of | 1891 | United Kingdom | 417/473 |

*Primary Examiner*—William H. Grieb
*Assistant Examiner*—Arnold W. Kramer

[57] ABSTRACT

A pair of separate but adjacently coupled, flexible, deformable, fluid filled resilient volumes are confined in an enclosure and are connected by a laminar fluid flow maximizing fluid pathway. The volumes, through fluid action, respond reciprocally to each other when body weight is applied alternately to each filled or partially filled volume. Through the use of a variable control fluid port inlet, a variable control fluid port outlet, and a variable control laminar fluid flow maximizing fluid resistance, the volumes characteristics can be modified in firmness, softness, height, depth and resistance to fluid flow. The result of the individual control and the combination of controls, when body force and body weight are applied to the volumes, is to cause the center of gravity of the body to move significantly along, but not limited to, the vertical axis and to cause the user of the device to utilize the muscles of the body in performing body movements of force and counter force when simulating walking, jogging, running, body balance maintenance and other body movements and motions relating to the animal and human body. Consequently, the muscular system and other body systems are strengthened, toned, conditioned, and stimulated.

9 Claims, 6 Drawing Figures

FIG. 1
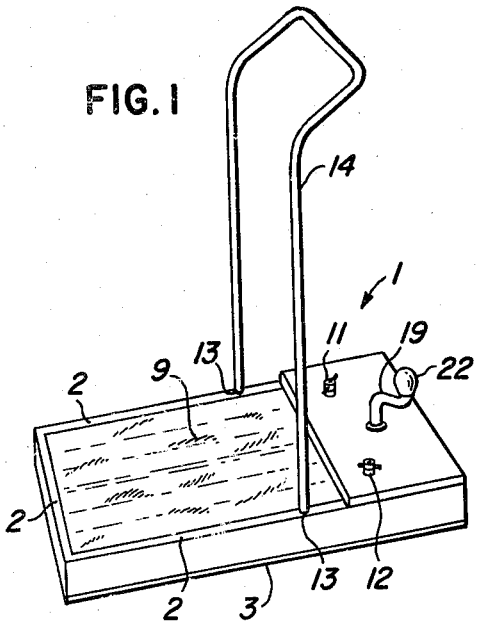
FIG. 2
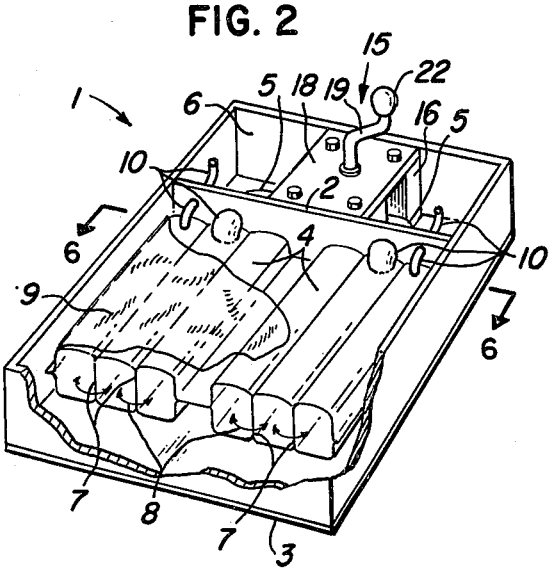
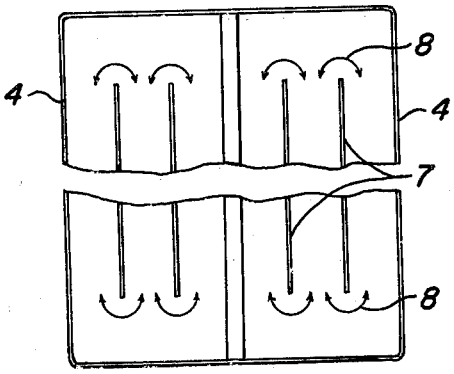
FIG. 3
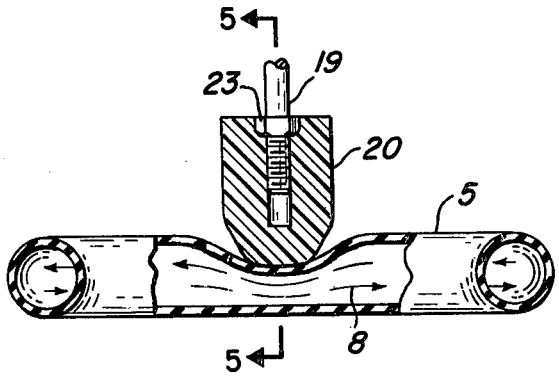
FIG. 4
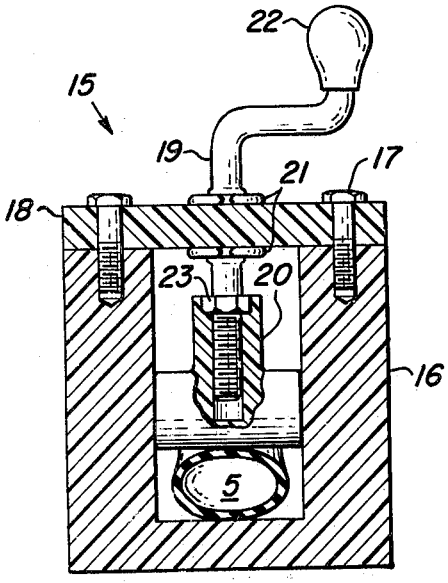
FIG. 5
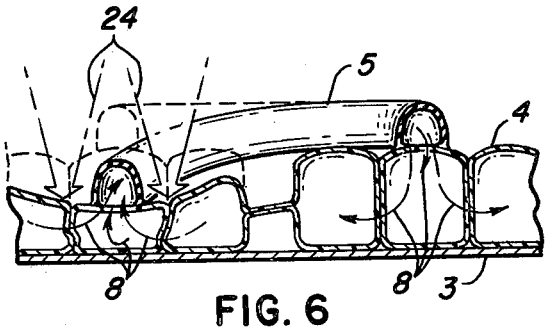
FIG. 6
INVENTOR:
ALBERT F. HRIBAR

FLUID FILLED EXERCISE DEVICE

BACKGROUND OF THE INVENTION

In order for the animal and human body to function properly, it must be exercised, or as derived from the Latin root word, exarcere, it must be "let out" — involved in movement. It is benefical to the body if such movement requires both conscious and reflex effort to be put forth by the person or animal. It is much more benefical if all systems of the body including muscular, cardiovascular, pulmonary, blood, and other systems involving balance, eye and brain are totally involved in rhythmic movements such as walking, jogging, running and other rhythmic body movements. These movements require the expenditure of gradually increasing energy or effort to facilitate hemo-oxygen exchange throughout the body, strengthen muscles and blood vessels, stimulate body organ functions and electrical and chemical actions and secretions. Also, it is more beneficial if these movements can be accomplished in an alternating compression-tension muscular action without a hammering or jarring effect on the various body parts or the total body.

Greater muscular effort and a higher energy output is required on terrain other than flat hard surfaces. Surfaces such as turf, mud, sand, deep sand, downhill, uphill, and uneven ground require greater exertion due to the shifting of the center of gravity of the body and the consequent muscular action necessary to maintain body balance. Not only are more effect and energy required, but more agility, flexibility, isometric and isotonic muscle action, and body-eye-brain coordination. The changing terrain causes the body to react with muscle actions and counter actions requiring more muscular effort, therefore more body benefits are derived in a shorter period of time than on a flat surface. A flat hard surface does not require the expenditure of a comparable effort since the body center of gravity is not moved any significant distance when running in place. Therefore, an uneven resilient surface and one that is capable of changing contour is desirable. This simulation of various types of terrain not only requires greater conscious and reflex effort in the rhythmic style but it is less monotonous and it generates more interest in exercising than a flat surface.

A review of patent documentation indicates that a few attempts have been made to provide resilient yielding surfaces with a change of resistance. However, the present invention provides resilient yielding surfaces and includes the capability of changing the surface characteristics and resistance, at will, to simulate changing terrain while the body is being exercised in a manner utilizing natural body movements and motions when simulating running, jogging, walking, balancing and other body movements and motions.

SUMMARY OF THE INVENTION

This invention relates in general to a fluid filled exercise device but more particularly to a fluid fillable exercise device that provides a pair of separate but adjacently coupled, confined, deformable, flexible, fluid fillable resilient volumes, connected by a laminar fluid flow maximizing fluid pathway, that respond reciprocally to each other when body weight is applied alternately to each filled or partially filled volume in simulating walking, jogging, running, balancing and other movements and motions relating to the animal or human body. In addition, this invention incorporates a variable control laminar fluid flow maximizing fluid resistance, a variable control fluid port inlet, and a variable control fluid port outlet. Separately and in combination these controls are capable of controlling and changing the volumes characteristics, through fluid action, in firmness, softness, height, depth and resistance to fluid flow between the volumes and, consequently, provide the user with a variety of simulated exercise surfaces and body energy output requirements.

It is the general object of this invention to provide a pair of separate but adjacently coupled, confined, flexible, deformable, fluid fillable, resilient volumes which are connected by a laminar fluid flow maximizing fluid pathway and are capable of supporting and suspending a body when the volumes are sufficiently filled with fluid.

Another object of this invention is to cause the volumes to interact and respond to each other reciprocally when body weight is applied alternately to the volumes so that they can be used by an animal or human body to simulate natural body movements inherent in walking, running, jogging, balancing and other body movements and motions.

Another object of this invention is to modify the resistance to fluid flow interchange between the volumes by selectively made adjustments of the laminar fluid flow maximizing resistance when such forces as body weight, body force and body movements are applied alternately to the volumes.

Another object of this invention is to modify the volumes in firmness, softness, height and depth by the variable controlled introduction of fluid into the volumes when body weight, body force and body movements are applied alternately to the volumes.

Another object of this invention is to modify the volumes in firmness, softness height and depth by the variable controlled exhausting of fluid from the volumes when body weight, body force and body movements are applied alternately to the volumes.

Another object of this invention is to modify the volumes in firmness, softness, height, depth and resistance to fluid flow between the volumes by the combination of controlling the introducing of fluid into the volumes, the exhausting of fluid from the volumes, and the resistance to fluid flow between the volumes as such forces as body weight, body force, and body movements and motions are applied alternately to the volumes.

Other objects of this invention will become evident to those skilled in the art from this specification and from examination of drawings and examples contained herein.

BRIEF DESCRIPTION OF THE DRAWINGS

FIG. 1 is an overall view of an exercise device of the present invention.

FIG. 2, a cutaway, shows an arrangement of various parts of the device.

FIG. 3 shows the restraining members in a top longitudinal volumes view.

FIG. 4, a closeup view, indicates the laminar fluid flow properties of the fluid pathway and the resistance plunger.

FIG. 5 shows the fluid pathway and resistance plunger taken in the line of 5—5 of FIG. 4.

FIG. 6 depicts the fluid pathway and the volumes reciprocating action taken in the line 6—6 in FIG. 2.

DETAILED DESCRIPTION

FIG. 1 shows an exercise device of the present invention. The two compartment enclosure Item 1 with volumes supporting and confining sides Item 2 and volumes supporting and confining bottom plate Item 3 is made of wood but can be made of metal, rubber, plastic, or any type of deformation resisting material of sufficient strength to support and confine the volumes FIG. 2 Item 4 when fluid pressure, body weight, and body force are applied alternately to the volumes Item 4. Openings in the front supporting and confining side Item 2 allow the fluid pathway Item 5 to enter and return from the resistance compartment Item 6.

The volumes Item 4 FIG. 2 are of the bladder type made from heat sealable, fluid retaining, synthetic film material, such as rubber or elastomers, and have flexible, deformable, fluid flow maximizing restraining members Item 7 FIG. 2. The restraining members Item 7 FIG. 2 are attached to the top and bottom inside surfaces of the volumes Item 4 FIG. 2 to prevent "pillowing" of the fluid filled volumes, and they are positioned to allow fluid Item 8 to flow around them as shown in FIGS. 2 and 3.

The volumes Item 4 are protected by a dirt repelling, abrasion resistant, flexible, deformable, stretch resistant, volumes protective covering Item 9 FIGS. 1 and 2 such as coated or impregnated fabric. The volumes protective covering Item 9 completely covers the volumes Item 4 but has openings to allow the fluid pathway Item 5 to pass through. The volumes Item 4 are allowed to "float" under the protective covering Item 9 which is attached to the enclosure bottom plate Item 3 to also confine the volumes Item 4 within the enclosure Item 1.

The laminar fluid flow maximizing fluid pathway Item 5 FIG. 2 and 6, is a flexible, deformable, resilient tubing, such as natural gum rubber, formed in a free flowing curvature to maximize laminar fluid flow and connect the volumes Item 4. It is secured adhesively or by tube rings to tube connectors Item 10 FIG. 2 which are sealed into the volumes Item 4. The tubing Item 5 is capable of being squeezed to zero cross sectional area and when released restores itself to its original cross sectional area and circumference dimensions.

The present invention utilizes air as the fluid Item 8 FIGS. 2,3,4, and 6 but it can be a gas or a liquid such as but not limited to air, water, and oil of varying viscosities and pressures above atmospheric pressure or in some cases the fluid can be at atmospheric pressure.

The variable control fluid port inlet Item 11 FIG. 1 is a needle valve which allows fluid to be introduced into the volumes in controlled amounts and is secured adhesively or with tube rings to tube connectors Item 10 FIG. 2 sealed into the volumes Item 4 FIG. 2.

The variable control fluid port outlet Item 12 FIG. 1 is a bleed valve which allows fluid to be exhausted in controlled amounts and is secured adhesively or with tube rings to tube connectors Item 10 FIG. 2 which are sealed into the volumes Item 4 FIG. 2.

The balance support receivers Item 13 FIG. 1 are tubular fittings, secured into the sides of the enclosure Item 1 FIG. 1, into which the user, balance support Item 14 FIG. 1 is insertable and removable. The user balance support Item 14 is made of tubular steel and shaped to provide user support in a number of body positions.

The variable control laminar fluid flow maximizing resistance is shown as Item 15 FIGS. 2 and 5. Referring to FIG. 5, the variable control laminar fluid flow maximizing fluid resistance comprises a flat bottom U-shaped hollow housing Item 16 with a bolted Item 17 on top plate Item 18 through which a screw rod Item 19 provides the means to drive a laminar fluid flow maximizing fluid resistance plunger Item 20. The screw rod Item 19 is held in position by C-rings Item 21 on top and bottom sides of the top plate Item 18 to restrict the vertical movement of the screw rod Item 19 but the screw rod Item 19 is free to rotate clockwise and counter clockwise and is roated by a handle Item 22 secured to the upper end of screw rod Item 19. The screw rod Item 19 engages and screws through a captured nut Item 23 in the resistance plunger Item 20. The resistance plunger Item 20 rides the screw rod Item 19 in the vertical axis and is prevented from rotating by the inside walls of the hollow housing Item 16 when the screw rod handle Item 22 is rotated. The fluid pathway Item 5, connected to the volumes Item 4 FIGS. 2 and 6, is positioned in, through, and at the bottom of the hollow housing Item 16. The bottom of the resistance plunger Item 20, as shown in FIGS. 4 and 5, is shaped in a broad, rounded, blunt chisel point to present a laminar fluid flow maximizing shape to which the fluid pathway Item 5 conforms when the resistance plunger Item 20 presses down upon the fluid pathway Item 5.

OPERATION

The action of the volumes, the fluid, and the fluid pathway is depicted in FIG. 6. The volumes Item 4 respond reciprocally to each other when body weight and body force Item 24 is applied alternately to each filled or partially filled volumes Item 4. The body weight and body force Item 24 causes the volumes Item 4 to deform along, but not limited to, the vertical axis when fluid Item 8 is displaced and replaced in the volumes Item 4, through the fluid pathway Item 5 by the alternating body weight and body force Item 24; lowering and raising the body. The lowering and raising of the center of gravity of the body, as body action continues, requires the body to expend more or less effort and energy as the body weight center of gravity moves up and down through greater or lesser controlled distances. The depth deformation of the volumes can be gradually or rapidly increased by opening the variable control fluid port outlet Item 12 FIG. 1 to exhaust fluid appropriately, hence the body center of gravity is caused to move a greater distance downward. The height deformation of the volumes can be increased by closing the variable control fluid port outlet Item 12 FIG. 1 and gradually or rapidly opening the variable control fluid port inlet Item 11 FIG. 1 to allow more fluid to be introduced into the volumes. The volumes height increases causes the body center of gravity to be moved a greater distance more or less in height. The firmness and softness of the volumes is controlled in much the same way but in conjunction with the variable control laminar fluid flow maximizing fluid resistance Item 15 FIG. 2 which adjusts the resistance. The resistance to fluid flow can be increased by rotating the variable resistance handle Item 22 FIG. 1 counter clockwise so the resistance plunger Item 20 FIG. 5 descends the screw rod Item 19 and squeezes down upon the fluid pathway Item 5. The cross sectional area of the fluid pathway Item 5 is reduced thus presenting less of an orifice for the fluid to flow through and thereby offering resistance to fluid flow. However, as shown in FIG. 4, due to the laminar fluid flow maximizing bottom surface contour of the resistance plunger Item 20 and the laminar fluid flow maximizing properties of the fluid pathway Item 5, fluid turbulence and fluid cavitation is minimized. Consequently, fluid flow is more laminar and a smooth, reasonably quiet fluid flow between the volumes is achieved. The greater resistance requires the body to use greater force to cause the volumes to reciprocate and, at the same time, the firmness of the volume is increased. Resistance to fluid flow is decreased by rotating the resistance plunger handle Item 22 FIG. 1 clockwise to cause the resistance plunger Item 20 FIG. 5 to ascend the screw rod Item 19 to allow the fluid pathway Item 5 FIG. 5 to restore itself and increase its cross sectional area and present a larger orifice for fluid Item 8 to flow through. This action also increases the softness of the volumes.

By increasing or decreasing the resistance and exhausting or introducing fluid sequentialy, a simulation of various types of terrain can be obtained in rapid succession. This is achieved by adjusting the controls as body weight and body force is applied alternately to the volumes. Body force and energy is applied and expended as required by the resistance and volume deformation.

The volumes are unstable under the user's body weight and body force and thus cause the user, in order to maintain an upright body balance position, to utilize the muscles of the body in performing body movements and motions of force and counter force to compensate for the varying volume characteristics and resistance requirements brought about by the adjustments to the controls. If required, a rigid user body balance support Item 14 FIG. 1 can be received by the balance support receivers Item 13 FIG. 1 in the enclosure Item 1 FIG. 1 to aid and support the user in maintaining body balance.

Although there has been illustrated and described a particular device it is clearly understood that the same was merely for the purpose of illustration and that changes, modifications, and other materials, fluids and pressures may be readily made and used herein by those skilled in the art without departing from the spirit and scope of this invention.

I claim:

1. A fluid fillable jogging exercise device comprising in combination:

a. a pair of separate but adjacently coupled, deformable, flexible, fluid containing, resilient volumes having substantially horizontal top surfaces lying in the same plane which, when sufficiently filled with fluid, support a jogging body;

b. said pair of resilient volumes having the capability of deforming and restoring the deformation when fluid is displaced and replaced from one to the other by alternating forces on the volumes through fluid pathway means coupling said adjacent volumes;

c. a fluid port inlet means to allow fluid to be introduced into the volumes; and d. an enclosure having side walls and end walls, said volumes are adjacently contained within said enclosure with said side and end walls resisting horizontal deformation of said volumes while any surface beneath said volumes may act as a bottom wall which would resist downward deformation of the bottoms of said volumes.

2. A fluid fillable jogging exercise device as recited in claim 1 wherein said enclosure further comprises a bottom wall.

3. A fluid fillable jogging exercise device as recited in claim 1 wherein said volumes are partially filled with a fluid.

4. A fluid fillable jogging exercise device as recited in claim 1 wherein each of said volumes inside top and bottom surfaces are connected to each other by flexible, deformable, restraining member means which are provided to restrain said volumes top and bottom outside surfaces from "pillowing" and thus achieve more flattened and level top and bottom outside surfaces of said volumes.

5. A fluid fillable jogging exercise device as recited in claim 1 wherein said fluid port inlet means comprises a variable control member to introduce fluid into said volumes in variable amounts.

6. A fluid fillable jogging exercise device as recited in claim 1 further comprising fluid port exhaust means for varying the amount of fluid in said volumes to affect said volumes characteristics.

7. A fluid fillable jogging exercise device as recited in claim 1 further comprising fluid flow resistance means associated with said fluid pathway means.

8. A fluid fillable jogging exercise device as recited in claim 7 wherein said fluid flow resistance means is a variable control structure for adjusting resistance to fluid flow in said fluid pathway means.

9. A fluid fillable jogging exercise device as recited in claim 1 further comprising flexible, deformable, abrasion resistant volumes protective covering means to protect said volumes.

* * * * *